United States Patent [19]

Vallillee

[11] 4,014,117

[45] Mar. 29, 1977

[54] SPECTATOR FOOTBALL VISUAL AID

[76] Inventor: Robert G. Vallillee, 87 Glynn Ave., Ottawa, Ontario, Canada, K1K 1S7

[22] Filed: Aug. 21, 1975

[21] Appl. No.: 606,578

[52] U.S. Cl. ..... 40/125 J; 33/289; 273/55 R

[51] Int. Cl.[2] ..... A63B 71/00; G09F 19/00

[58] Field of Search ..... 116/120; 340/323, 332, 340/333; 273/55 R, 1.5 R; 40/125 J; 33/289

[56] References Cited

UNITED STATES PATENTS

| | | | |
|---|---|---|---|
| 2,064,745 | 12/1936 | Harvie | 33/289 X |
| 2,461,836 | 2/1949 | Nelson | 340/323 |
| 3,258,763 | 6/1966 | Klein | 340/332 |
| 3,302,192 | 1/1967 | Laughlin | 340/323 |
| 3,825,261 | 7/1974 | Zapos | 273/55 R |
| 3,856,302 | 12/1974 | Karkoska | 340/323 X |

*Primary Examiner*—Richard C. Queisser
*Assistant Examiner*—Daniel M. Yasich
*Attorney, Agent, or Firm*—Jack D. Slobod

[57] ABSTRACT

A visual aid for football spectators includes red and green lights on poles associated with a particular game object, which are selectively energized by remote control to indicate the success or failure to achieve the particular game object. In one embodiment the poles are goal posts and the lamps indicate the success or failure of a touchdown, field goal or conversion attempt. In another embodiment the poles are yardsticks and the lamps signal the achievement or lack of achievement of a first down.

2 Claims, 5 Drawing Figures

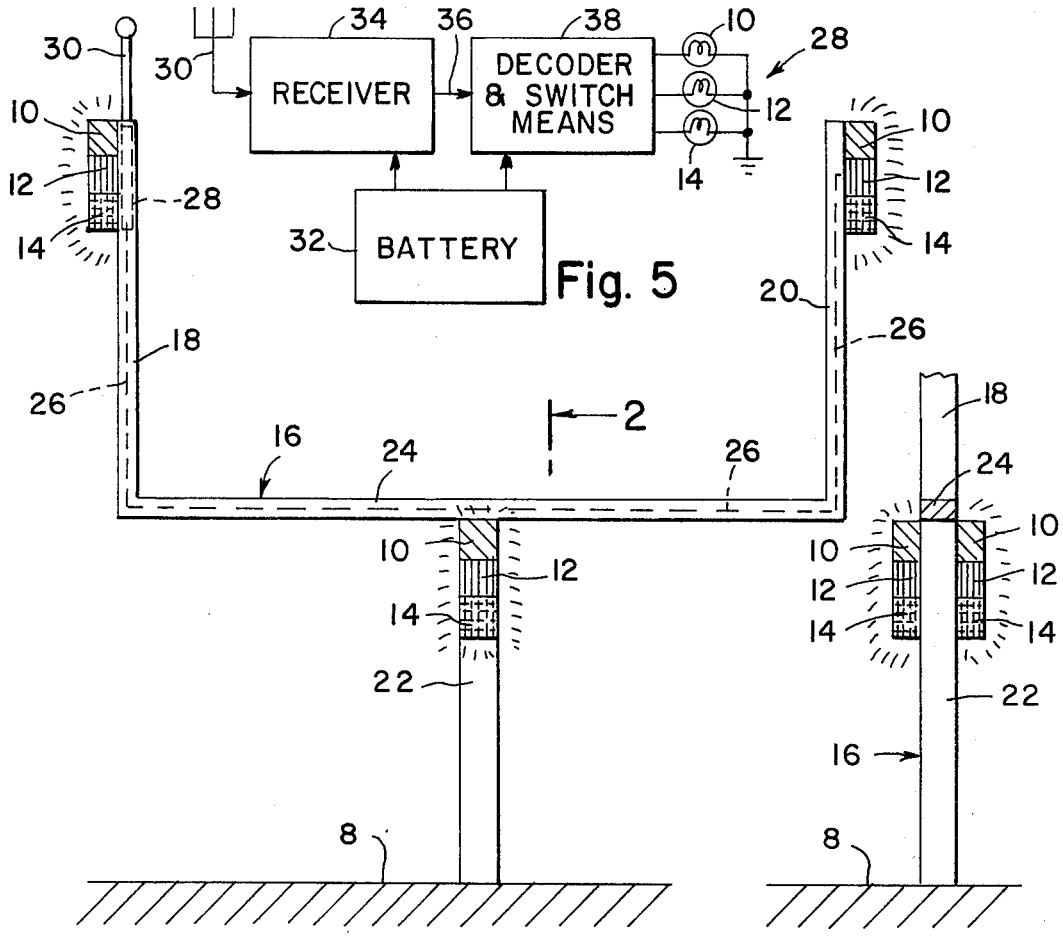
Fig. 5
Fig. 1
Fig. 2
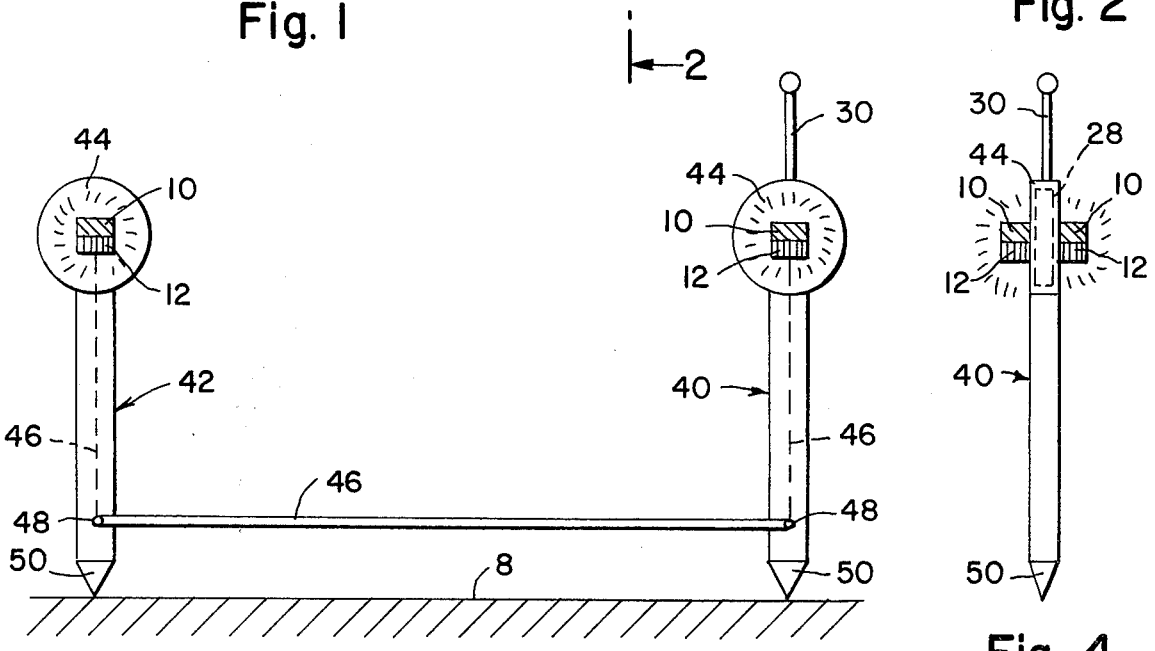
Fig. 3
Fig. 4

SPECTATOR FOOTBALL VISUAL AID

FIELD OF THE INVENTION

The present invention relates generally to devices for indicating the status of play in a sport. In its particular aspects, the present invention relates to the provision of radio controlled lamps on common sport devices associated with attainment of particular game objects.

BACKGROUND OF THE INVENTION

Avid spectators of sporting events such as football games frequently view the game from positions which make it difficult to know whether various scoring attempts or first down attempts have been successful, detracting from the enjoyment of the game. Also the referee's hand signal on the usual scoreboard may be blocked from view. While various indicating devices for football games have been known to apprise the crowd of the game status, none to my knowledge have been located on play instruments associated with particular game objects for actuation by radio control.

OBJECTS OF THE INVENTION

It is an object of the present invention to provide visual indicators on play instruments associated with particular game objects which indicators may be operated remotely by a referee or official scorer.

It is further object of the present invention to provide a play status visual indicator for football games which will enhance the excitement of the game and which will be readily visible to the spectators.

SUMMARY OF THE INVENTION

Briefly, the aforementioned and other objects of the present invention are satisfied by mounting red and green lights on a pole means located on the field of play. A radio receiver and switch means responsive thereto are provided on the pole means for energizing selectively either the green lamp or the red lamp to respectively indicate success or failure to achieve a game object associated with the playing means. Due to the provision of the radio receiver and switch means, the lamps may be controlled from a remote location such as the official scorer's table.

In one embodiment the pole means is a set of goal posts and the lamps indicate the success or failure of an attempted field goal, touchdown, conversion or safety.

In another embodiment the pole means is a pair of down measuring sticks. Each of the sticks carry indicator lamps. In order to provide the radio receiver and switch means on only one stick, the usual ten yard chain between the sticks is replaced by an electrical cable of the proper length.

Other objects, features and advantages of the present invention will become apparent upon perusal of the following detailed description of the preferred embodiments thereof when taken in conjunction with the appended drawing wherein:

FIG. 1 is a front elevational view of a set of goal posts according to the present invention;

FIG. 2 is a partial side elevation of FIG. 1;

FIG. 3 is an elevational view of a pair of down measuring sticks according to the present invention;

FIG. 4 is a side view of FIG. 3; and

FIG. 5 is an electrical block diagram for the goal post of FIG. 1.

DETAILED DESCRIPTION

The play status indicating technique of the present invention is directed to placing visual indicating devices on instruments located on the field of play 8 of a football game which are associated with particular game objects. According to the first embodiment of the present invention, illustrated in FIGS. 1 and 2, vertical groupings of preferably green, red and amber lamps, indicated respectively by the reference numerals 10, 12, and 14, are mounted on a goal post set 16 at various locations.

To provide high visibility to the spectators of the football game, the individual groupings of lamps 10 through 14 are mounted respectively along the top ends of the left and right uprights 18 and 20 and along the top of the goal post trunk 22. For further visibility, the lamps on trunk 22 are provided in separate groupings on the front and back thereof.

Preferably the left and right uprights 18 and 20 as well as the cross bar 24 therebetween are hollow tubular members to enable the lamps of the same color at the various locations to be connected in parallel with a cable 26 passing through the tubular members.

Located within left upright 18 at the top end thereof is electrical circuitry 28 from which emanates an upstanding dipole antenna 30 projecting from the end of the upright. As shown in FIG. 5, the circuitry 28 includes a battery 32 which powers a radio receiver 34 connected to antenna 30. The output 36 of receiver 34 is applied to a decoder and switch means 38. Preferably a signal is broadcast to receiver 34 having any of three different modulation frequencies selectively imposed on a suitable carrier frequency to indicate which color lamps are to be energized.

Thus, by setting up a simple one to one correspondence between each modulation frequency and each lamp the decoder and switch means may connect the battery to the appropriate lamps in response to receipt of the modulated signal from receiver output 36. It should be understood that numerous techniques are well known for remote control of plural devices in response to a coded signal, any of which may be utilized in the present invention.

It will be appreciated that the signal for controlling the energization of lamps 10 through 14 may be broadcast from a suitable transmitter carried by a referee or located near an official scorer.

In utilizing the device of FIGS. 1 and 2, the green lamps 10 and the red lamps 12 are selectively energized by remote command to respectively indicate the success or failure of an attempted field goal, touchdown, conversion, or safety. The amber lamps 14 are selectively energized to indicate the occurrence of a penalty during one of the aforementioned scoring attempts.

In the embodiment of the invention illustrated in FIGS. 3 and 4, in conjunction with a pair of down measuring sticks 40 and 42. Each of the sticks 40 and 42 are hollow tubular members provided with a circular head 44 carrying two individual sets of green and red lamps 10 and 12 on opposite end faces thereof. The four green lamps 10 and the four red lamps 12 are respectively connected in separate parallel combinations. The lamps of the different sticks are appropriately coupled by a cable 46 running within the sticks 40 and 42 from the heads 44 to an opening 48 near the pointed bottoms 50 of the sticks and extending horizontally between the openings 48.

As should be apparent from FIG. 2, the section of the electrical cable 46 which extends horizontally between the sticks 40 and 42 takes the place of the usual measuring chain and is therefore of a length to provide a distance of ten yards between the sticks 40 and 42 when they are fully separated.

Within the circular head 44 of stick 40 is located the circuitry 28 which is coupled to the dipole antenna 30 upstanding from the head. The circuitry 28 therein is essentially identical to that depicted in FIG. 5 with the omission of amber lamps 14.

In the use of the measuring sticks 40 and 42 for play indication purposes, a suitable signal is transmitted to the receiver 34 therein by the referee or official scorer to command the energization of either the green lights 10 or the red lights 12. The green and red lights are respectively indicative of the success or failure of a first down attempt. Such indication is particularly visible when the sticks have been brought onto the playing field 8 for measuring purposes.

Having described the preferred embodiments of the present invention in specific detail, it should be apparent that numerous modifications, additions and omissions in the details thereof are possible within the intended spirit and scope of the invention.

What is claimed is:

1. Football play status indicating apparatus responsive to a remote control radio signal, said apparatus comprising: a pair of portable first down measuring sticks; an electrical cable of a predetermined length being the only means interconnecting said sticks for enabling said sticks to define a predetermined distance when said sticks are spaced apart a distance for maintaining said cable taught therebetween; a pair of lamp means respectively carried on said pair of sticks for indicating the status of play; said pair of lamp means being electrically interconnected via said cable; radio receiver means, switch means and battery means carried by one of said sticks; said switch means being electrically interposed between said battery means and said pair of lamp means and being controlled by an output of said receiver means for selectively electrically coupling said battery means to said pair of lamp means in response to receipt of said remote control radio signal by said receiver means.

2. The apparatus of claim 1 wherein each said lamp means comprises a plurality of individually energizeable differently colored lamps; said remote control signal being selected from a plurality of different signals respectively for selectively commanding energization of differently colored ones of said lamps, said signals and the colors of said lamps being in one to one correspondence; said switch means further comprising means for coupling said battery means to lamps of colors corresponding to said signals as said signals are present at the output of said receiver means.

* * * * *